United States Patent [19]

Ellison et al.

[11] Patent Number: 4,723,337

[45] Date of Patent: Feb. 9, 1988

[54] HIGH PRESSURE CARPET OR RUG CLEANING APPARATUS

[75] Inventors: Clifford D. Ellison, Columbia; George E. Shumpert, West Columbia, both of S.C.

[73] Assignee: Shumpert & Ellison, Inc., Columbia, S.C.

[21] Appl. No.: 939,750

[22] Filed: Dec. 9, 1986

[51] Int. Cl.[4] ..... A47L 11/30

[52] U.S. Cl. ..... 15/300 A; 15/321; 15/353

[58] Field of Search ..... 15/321, 353, 300 A

[56] References Cited

U.S. PATENT DOCUMENTS

| | | | |
|---|---|---|---|
| 4,080,104 | 3/1978 | Brown | 15/353 X |
| 4,153,968 | 5/1979 | Perkins | 15/321 |
| 4,168,563 | 9/1979 | O'Bryan | 15/321 |
| 4,542,556 | 9/1985 | Hepple | 15/321 |
| 4,651,380 | 3/1987 | Ogden | 15/321 |

*Primary Examiner*—Chris K. Moore

*Attorney, Agent, or Firm*—Brady, O'Boyle & Gates

[57] ABSTRACT

A single unit readily portable carpet and rug cleaning apparatus receives water directly from any spigot into a high pressure pump without the necessity for a clean water holding tank. Shampoo or cleaning concentrate from an outside container is delivered by siphoning to the incoming water stream being delivered to the high pressure pump. The high pressure cleaning liquid is delivered through a high pressure line extending along a vacuum wand directly onto the carpet or rug through a high pressure nozzle close to floor level. Simultaneously, water and dirt are withdrawn from the carpet or rug through a suction head and delivered through the vacuum wand and a vacuum hose to a dirty water holding tank within the apparatus by the action of twin vacuum motors. When the recovered dirty water reaches a certain level in the holding tank, a float actuates a switch causing the dirty water to be pumped from the holding tank into any convenient drain, commode, laundry tray or sewer. A second float-operated switch automatically cuts off the vacuum pump motors if for any reason the dirty water pump out system malfunctions. Dirty water entering the apparatus holding tank is filtered to remove debris and large particulate matter. Dirty water is never reused by the apparatus in the cleaning mode.

8 Claims, 8 Drawing Figures

HIGH PRESSURE CARPET OR RUG CLEANING APPARATUS

BACKGROUND OF THE INVENTION

1. Technical Field

The present invention relates to an improved cleaning apparatus particularly for carpets or rugs but being capable of other uses.

2. The Prior Art

Many and diverse types of carpet cleaning machines are known in the prior art. One prior art machine involves a rather large unit which is awkward to move around in close quarters, such unit possessing separate holding tanks for clean and soiled water.

Other prior art machines for cleaning carpet are operated on tap water pressure of generally less than 60 psi which does not produce the deep cleaning action necessary for thorough carpet cleaning.

Other prior art machines involve dual apparatus units, one for cleaning and one for collecting returned dirty water. Dual unit machines are obviously more difficult to transport and to move around at the job site.

It is the objective of the present invention to eliminate the above drawbacks of the known prior art by providing a single unit easily portable more compact carpet or rug cleaning apparatus containing a high pressure pump which can receive water directly from a tap and increase the water pressure adjustably from zero to 1000 psi so that the clean water mixed with a suitable cleaning agent can be directed onto a soiled carpet at much greater pressures than those heretofore employed for a much more effective cleaning action.

A further important object of the invention is to provide a cleaning apparatus of the above-mentioned type whose exterior dimensions are minimized due to the fact that no storage tank for clean water is necessary and further due to the fact that the pumps and associated components within the apparatus housing are much more compactly arranged than in the prior art.

A further object of the invention is to provide a highly efficient carpet cleaning apparatus which is extremely simple and convenient to hook up for use, the apparatus requiring only one man to operate, and allowing full use of the operator's time and energy for the actual cleaning operation, instead of for transporting and setting up the apparatus.

Other objects and advantages of the invention will become apparent to those skilled in the art during the course of the following description.

SUMMARY OF THE INVENTION

The invention is best summarized as a single unit compact readily portable cleaning apparatus for carpets and the like having an enclosed high pressure pump adapted to be connected directly with a houshold spigot supplying city water to the pump at normal city water pressure. The pump delivers high pressure cleaning water with or without a cleaning agent siphoned from a container outside of the apparatus to the carpet for deeply and effectively cleaning its pile. Twin vacuum motors within the apparatus simultaneously suck soiled water from the carpet and deliver it through a wand and hose to a filter associated with a dirty water holding tank within the apparatus from which the dirty water is pumped into a sewer drain or the like after reaching a sufficient level to activate a float-operated switch which turns on a dirty water discharge pump. A second float at a higher elevation activates a second switch to cut off both vacuum pump motors to prevent damaging these motors should the water level in the dirty water tank become too high.

DETAILED DESCRIPTION

Figure 1:
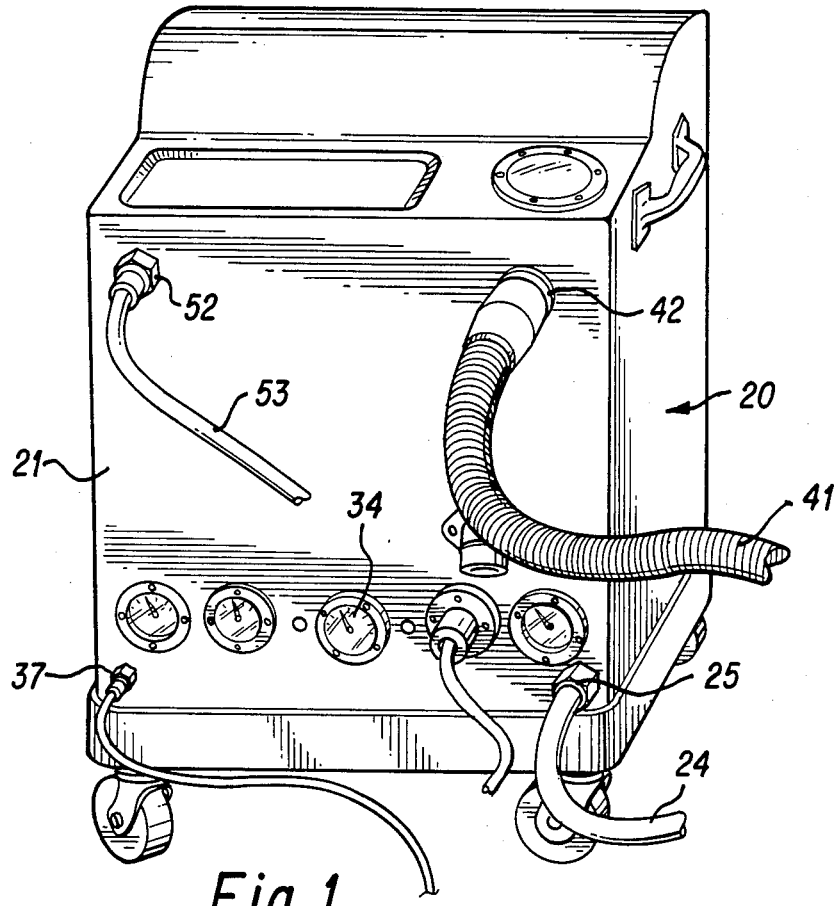
FIG. 1 is a front perspective view of a high pressure carpet or rug cleaning apparatus according to the present invention.
Figure 2:
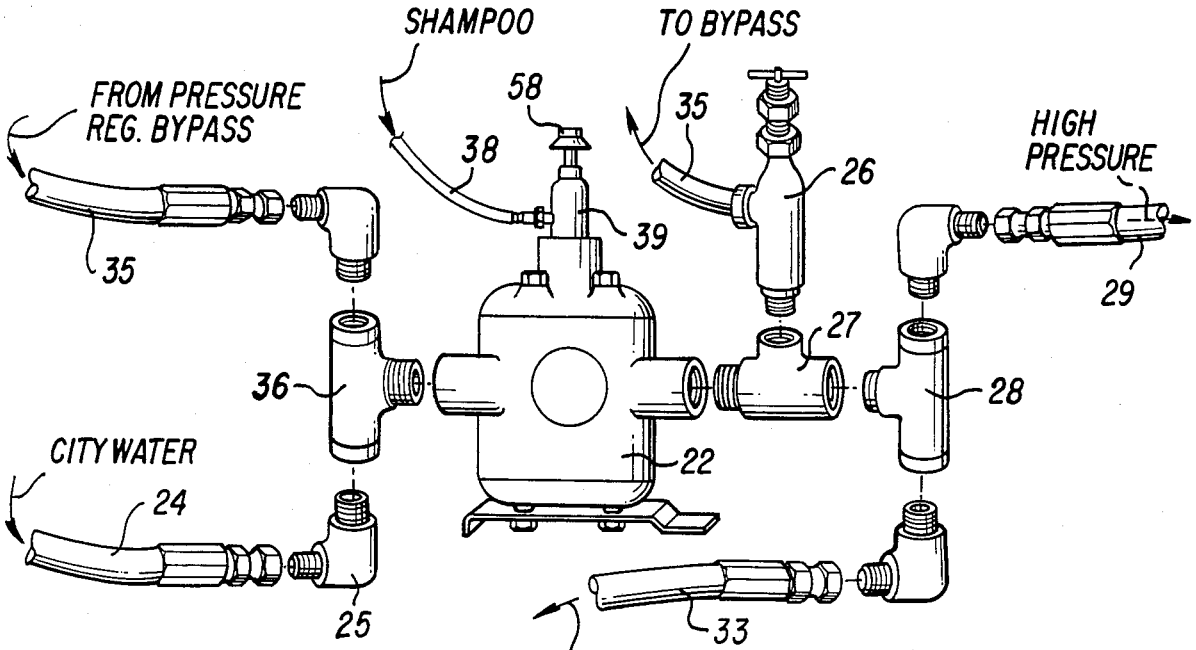
FIG. 2 is an exploded view of a high pressure pump and associated elements provided in the apparatus.
Figure 3:
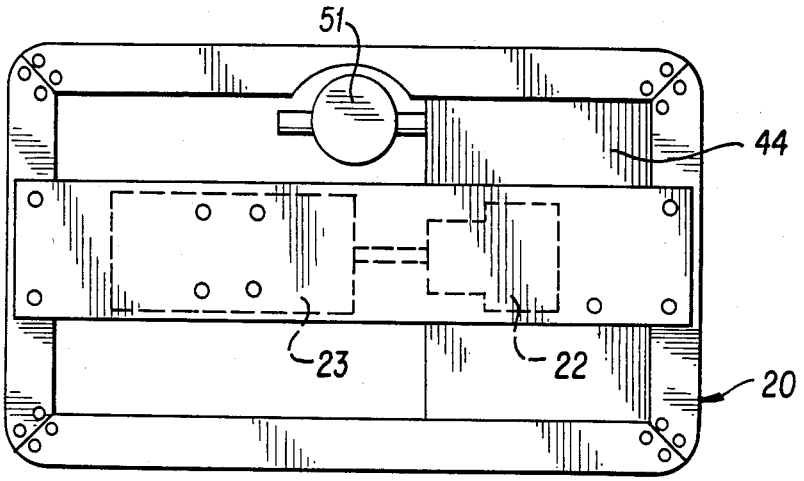
FIG. 3 is a bottom plan view of the apparatus.
Figure 4:
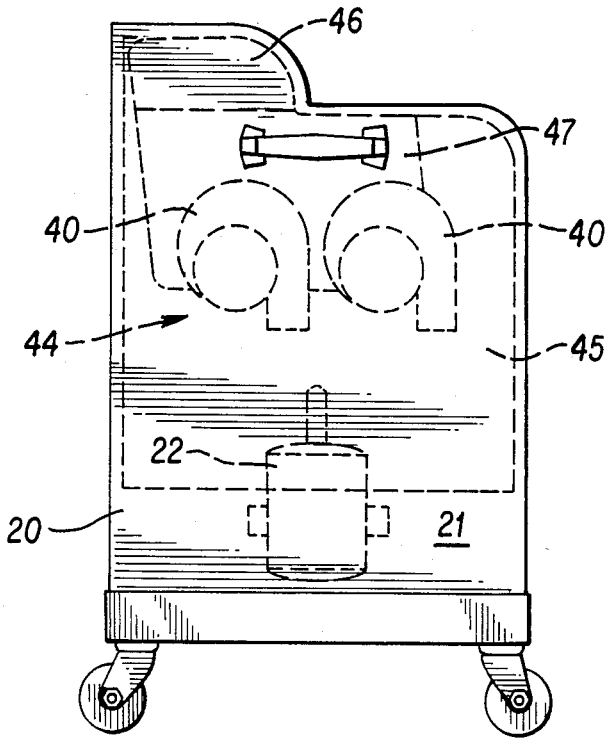
FIG. 4 is a side elevation thereof.

Referring to the drawings in detail wherein like numerals designate like parts, a single unit wheeled compact carpet cleaning apparatus 20 includes a housing 21 within the lower portion of which is mounted a high pressure pump 22 driven by a motor 23. The pump has the ability to supply water for carpet cleaning in an adjustable pressure range from zero to 1000 psi. The apparatus is equipped with conventional controls to regulate the output pressure of the pump 22.

Figure 5:
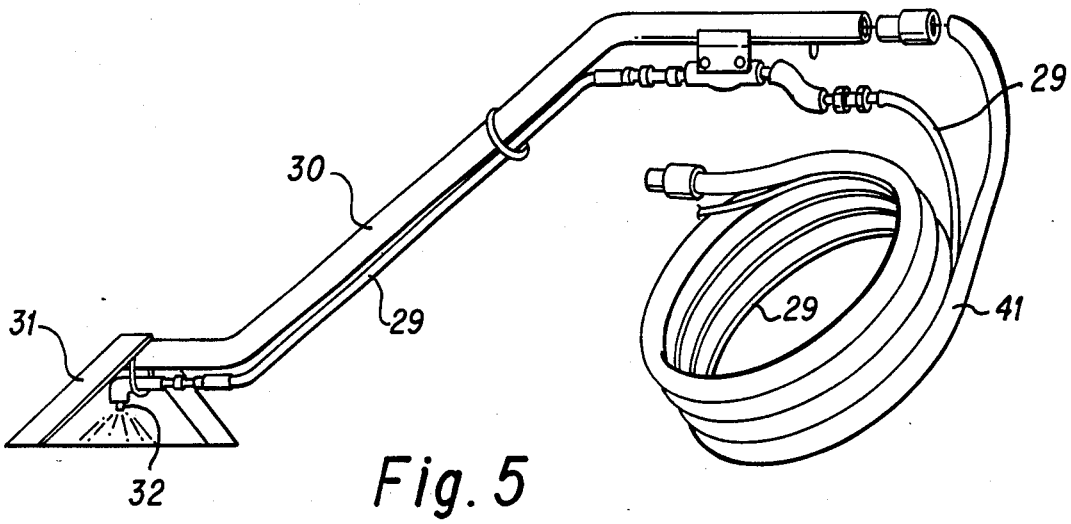
FIG. 5 is a side elevation of a vacuum wand and associated elements.
Figure 6:
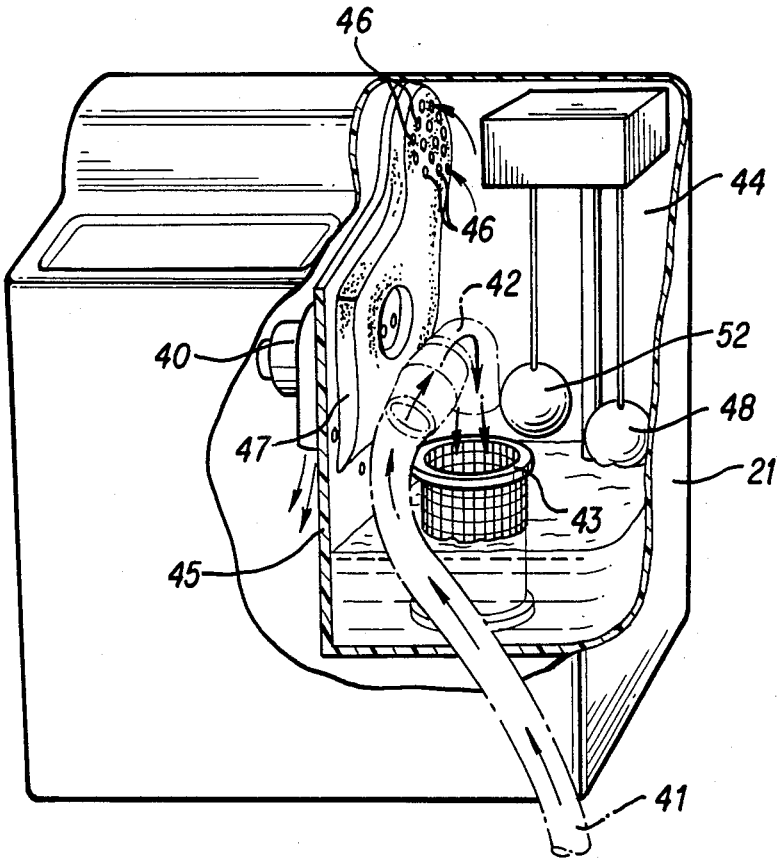
FIG. 6 is a fragmentary perspective view of the apparatus showing a dirty water holding tank or reservoir, dirty water filter and vacuum motors.
Figure 7:
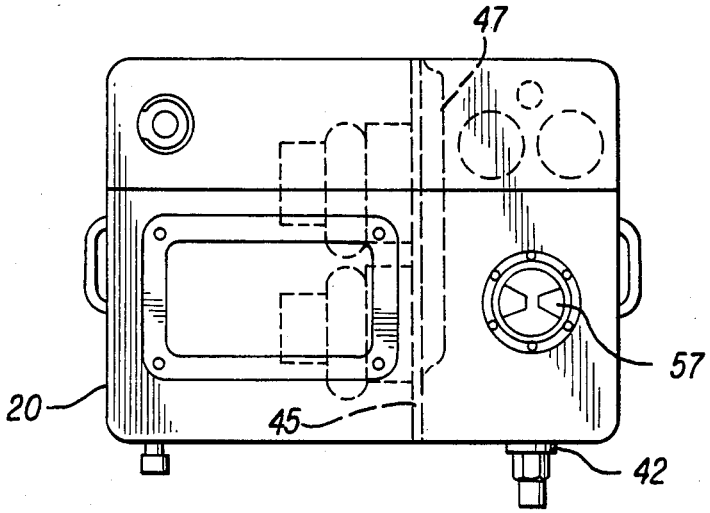
FIG. 7 is a plan view of the apparatus.
Figure 8:
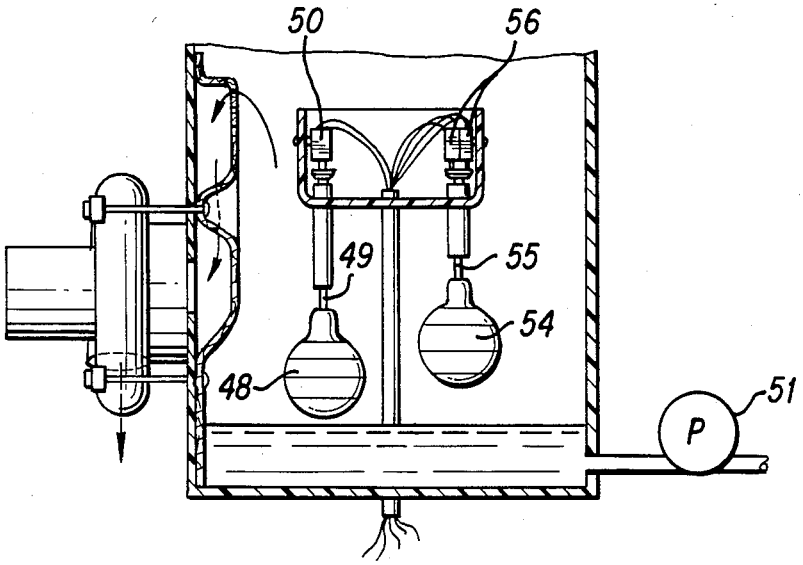
FIG. 8 is a fragmentary rear elevation of the apparatus showing float-operated switches which control the operation of the dirty water discharge pump and the motors of the twin vacuum motors of the apparatus.

Clean water from a convenient spigot is delivered at city water pressure through a hose 24 to a clean water inlet 25 of the apparatus with which the hose is coupled. A pressure regulator 26 is connected with the pump 22 through a T-fitting 27, connected through another T-fitting 28 to a high pressure tube 29 extending along a suction wand 30 to a point near a suction head 31 of the wand. A high pressure cleaning nozzle 32, FIG. 5, is provided on the end of the tube 29 to direct cleaning liquid onto the carpet being cleaned. The nozzle 32 is spaced only slightly above floor level.

Through the fitting 28, pump 22 is connected to another hose 33 leading to a pressure gage 34 on the forward wall of the housing 21. A bypass line 35 from the pressure regulator 26 is connected back to the pump 22 through a T-fitting 36. the high pressure tube 29 exits the housing 21 through a fitting 37 near one lower corner thereof.

Shampoo or a cleaning concentrate from a container external to the unit 20 is delivered by siphoning through a tube 38 to a shampoo head 39 on the head pressure pump 22.

Twin vacuum motors 40 in the upper portion of housing 21 are connected through a vacuum hose 41 of suitable length to the wand 30 carrying the vacuum head 31. Dirty water withdrawn from the carpet by the high power vacuum pumps 40 enters the unit 20 through an inlet fitting 42 near one top corner of the unit 20 on its forward wall. The returning dirty water first flows through an upright axis filter 43 in the housing 21, the filter being disposed within a dirty water holding tank 44 within the upper portion of the housing. The filter 43 removes debris and other large particles from the returning dirty water. The tank 44 has an internal partition wall 45 having apertures 46 formed in an expanded portion 47 of the wall near its top to prevent debris, lint, fiber or water from being drawn into the vacuum motors 40 and to allow air to pass through to create a vacuum. The motors 40 are mounted on the interior vertical wall 45 of the dirty water holding tank 44.

When the dirty water being returned to the holding tank 44 reaches a certain level, a first float 48 in the tank having a relatively long lifter rod 49 rises and actuates a control switch 50, turning on a dirty water discharge pump 51 near the rear wall of the housing 21. This discharge pump pumps the dirty water from the tank 44 through a dirty water discharge fitting 52 near the other front top corner of the unit 20, the fitting 52 being connected with a suitable dirty water hose 53 of required length leading to a commode, sewer drain or the like.

A second float 54 in the tank 44 having a shorter lifter rod 55 operates switches 56 automatically cutting off both vacuum motors 40, thereby preventing the possibility of rising water entering and damaging the vacuum motors. Thus, the apparatus is equipped with a strong and reliable safety system.

The dirty water discharge pump 51 has a 300 gpm capacity to expel the dirty water quickly through the outlet fitting 52 and hose 53.

The filter 43 can be lifted out for cleaning through a clean-out plate 57 provided on the top wall of the housing 20.

While the apparatus is described in terms of its main usage for cleaning carpets, it may also be used for washing cars or aircraft and for other industrial cleaning.

The use of the two high power vacuum motors 40 imparts to the apparatus superior carpet drying action. This faster drying is a very important factor in carpet cleaning, especially in public places.

The dirty water retrieval system can be operated independently of the high pressure cleaning system, allowing full use of the apparatus for drying operations after hurricanes or flooding from other causes. The apparatus thus has great flexibility of usage. Its extreme compactness enables one man operation and adapts the apparatus to stairways, elevators and the like.

It should be mentioned briefly that the desired mix of water with shampoo in the cleaning apparatus is controlled by a flow meter having an adjusting means 58 of a conventional nature.

It should be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A high pressure carpet cleaning apparatus of single unit construction comprising, a housing means, a high pressure pump and pump motor within a lower portion of the housing means adapted to receive water at city water pressure through a water inlet fitting on the housing means and also adapted to receive a cleaning agent from a container external to the housing means, said high pressure pump having a pressure regulator connected to the pump outlet, a head of cleaning concentrate and adjustable flow meter means communicating with the inlet of said high pressure pump, and a conduit having one end connected to said external cleaning concentrate container and the opposite end connected to said cleaning concentrate head, whereby the desired mix of water and cleaning concentrate may be controlled, a high pressure delivery line leading from said pump through a high pressure outlet fitting on the housing means, a dirty water holding tank within the upper portion of the housing means and containing a removable filter, twin vacuum motors on a wall of the holding tank for drawing dirty water through a vacuum inlet fitting on the housing means and delivering the dirty water through said filter into the dirty water holding tank, a dirty water discharge pump in the rear portion of the housing means adapted to pump water from said holding tank through a dirty water discharge fitting on the housing means to a dirty water discharge line, and a float switch means in the dirty water holding tank operable to turn on the dirty water discharge pump when the dirty water level in said tank reaches a certain elevation and operable to shut off the twin vacuum motors if the dirty water level in said tank reaches a second and higher elevation therein.

2. A high pressure carpet cleaning apparatus as defined in claim 1, and a vacuum wand having a vacuum head and vacuum hose connected with said vacuum inlet fitting of the housing means, and said high pressure delivery line extending along the vacuum wand and including a high pressure cleaning nozzle adjacent to said vacuum head.

3. A high pressure carpet cleaning apparatus as defined in claim 1, and said float switch means including separate float switches for turning on the dirty water discharge pump and for shutting off the twin vacuum motors, a first float having a relatively long lifter rod for activating the switch which turns on the dirty water discharge pump, and a second float having a shorter lifter arm for activating switches which shut off the twin vacuum motors.

4. A high pressure carpet cleaning apparatus as defined in claim 1, and said dirty water holding tank having a partition wall between said filter and said twin vacuum motors, and said partition wall being perforated near its top above said vacuum motors to allow clean air to pass therethrough to the vacuum pumps.

5. A high pressure carpet cleaning apparatus of single unit construction comprising, a housing means, a high pressure pump and pump motor within a lower portion of the housing means adapted to receive water at city water pressure through a water inlet fitting on the housing means and also adapted to receive a cleaning agent from a container external to the housing means, a high pressure delivery line leading from said pump through a high pressure outlet fitting on the housing means, a dirty water holding tank within the upper portion of the housing means and containing a removable filter, twin vacuum motors on a wall of the holding tank for drawing dirty water through a vacuum inlet fitting on the housing means and delivering the dirty water through said filter into the dirty water holding tank, said dirty water holding tank having a partition wall between said filter and said twin vacuum motors, said partition wall being perforated near its top above said vacuum motors to allow clean air to pass therethrough to the vacuum pumps, a dirty water discharge pump in the rear portion of the housing means adapted to pump water from said holding tank through a dirty water discharge fitting on the housing means to a dirty water discharge line, and a float switch means in the dirty water holding tank operable to turn on the dirty water discharge pump when the dirty water level in said tank reaches a certain elevation and operable to shut off the twin vacuum motors if the dirty water level in said tank reaches a second and higher elevation therein.

6. A high pressure carpet cleaning apparatus as defined in claim 5, and a vacuum wand having a vacuum head and vacuum hose connected with said vacuum inlet fitting of the housing means, and said high pressure delivery line extending along the vacuum wand and including a high pressure cleaning nozzle adjacent to said vacuum head.

7. A high pressure carpet cleaning apparatus as defined in claim 5, and said float switch means including separate float switches for turning on the dirty water discharge pump and for shutting off the twin vacuum motors, a first float having a relatively long lifter rod for activating the switch which turns on the dirty water discharge pump, and a second float having a shorter lifter arm for activating switches which shut off the twin vacuum motors.

8. A high pressure carpet cleaning apparatus as defined in claim 5, and said high pressure pump having a pressure regulator connected to the pump outlet, a head of cleaning concentrate and adjustable flow meter means communicating with the inlet of said high pressure pump, and a conduit having one end connected to said external cleaning concentrate container and the opposite end connected to said cleaning concentrate head, whereby the desired mix of water and cleaning concentrate may be controlled.

* * * * *